US006410171B1

(12) United States Patent
Paulson

(10) Patent No.: US 6,410,171 B1
(45) Date of Patent: Jun. 25, 2002

(54) PROTECTING METAL FROM CARBON

(75) Inventor: Thomas E. Paulson, Corning, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/652,078

(22) Filed: Aug. 31, 2000

(51) Int. Cl.[7] ..... B32B 9/00

(52) U.S. Cl. ..... 428/697; 428/702; 428/472; 428/469; 428/34.4; 427/190; 427/193; 106/286.5; 106/286.7; 106/286.8; 106/287.17; 501/4; 501/128; 501/153; 501/154; 138/145; 156/89.11

(58) Field of Search ..... 428/469, 472, 428/697, 702, 34.4; 501/128, 153, 154, 4, 5; 106/286.5, 286.7, 286.8, 287.17; 138/145; 427/190, 193; 156/89.11

(56) References Cited

U.S. PATENT DOCUMENTS 4,478,641 A * 10/1984 Adair et al.
5,250,360 A 10/1993 Andrus et al. ..... 428/471
5,298,332 A 3/1994 Andrus et al. ..... 428/469
5,618,763 A 4/1997 Frank et al. ..... 501/5
5,807,616 A 9/1998 Trotter, Jr. ..... 428/34.4
6,071,563 A 6/2000 Kozlowski et al. ..... 427/364.7

OTHER PUBLICATIONS

U.S. application No. 09/401,176, Grossman, filed Sep. 22, 1999.

* cited by examiner

*Primary Examiner*—Deborah Jones
*Assistant Examiner*—Wendy Boss
(74) *Attorney, Agent, or Firm*—Milton M. Peterson; Siwen Chen

(57) ABSTRACT

A component of a thermal processing apparatus for a fluid stream of hydrocarbons, a precursor glass for a glass-ceramic coating on such component and a method of inhibiting deposition of a material, such as carbon, on a surface of the component.

23 Claims, 2 Drawing Sheets

FIG. 2 Average CTE of Leucite-Anorthite Cerammed Frits
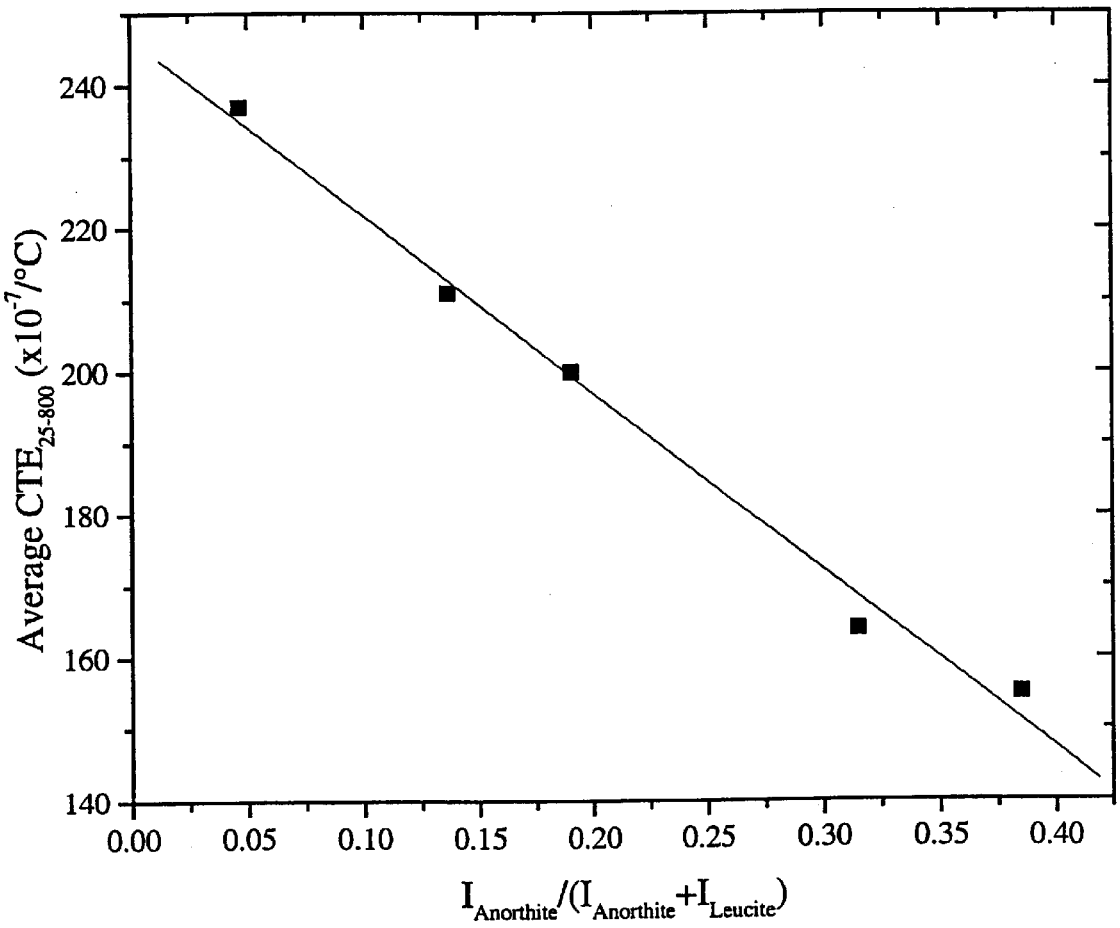

PROTECTING METAL FROM CARBON

FIELD OF THE INVENTION

A method of protecting metal bodies, such as components of a thermal cracking furnace, a catalytic reforming heater, or a chemical processing tube, against carburization, corrosion, and formation of carbon deposits, and the metal components so protected.

BACKGROUND OF THE INVENTION

The invention is basically concerned with protecting the surface of a metal body against the deposition of carbon on that surface, and against the detrimental effects that result from such carbon deposition. A specific area of concern is protection of the components of a furnace employed in the thermal cracking of hydrocarbons such as ethane, propane, butane, naphtha, or gas oil, to form olefins, such as ethylene, propylene, or butenes.

Another area of concern is a catalytic reforming process. There, a pre-heater is used to heat naphtha feedstocks up to a reaction temperature of about 550–650° C.

The invention is directed at avoiding, or at least lessening, the formation of carbon deposits, commonly referred to as coke, on the furnace components, such as the wall of a reactor tube, during a thermal cracking process. Therefore, the invention is described in terms of this particular utility, although its wider application will be apparent.

At the heart of a thermal cracking process is the pyrolysis furnace. This furnace comprises a fire box through which runs an array of tubing. This array may be a set of straight tubing fed from a manifold, but frequently is a serpentine array of tubing. In either case, the array is composed of lengths of tubing and fittings that may total several hundred meters in length. The array of tubing is heated to a carefully monitored temperature by the fire box. A stream of feedstock is forced through the heated tubing under pressure and at a high velocity, and the product is quenched as it exits. For olefin production, the feedstock is frequently diluted with steam. The mixture is passed through the tubing array which is commonly operated at a temperature greater than 650° C. During this passage, a carbonaceous residue is formed and deposits on the tube walls and fittings.

Initially, carbon residue appears in a fibrous form on the walls. It is thought this results from a catalytic action, primarily due to nickel and iron in the tube metal. The carbon fibers on the tube wall appear to form a mat by trapping pyrolitic coke particles formed in the gas stream. This leads to buildup of a dense, coke deposit on the walls of the tubing and fittings.

The problem of carbon deposits forming during the thermal cracking of hydrocarbons is one of long standing. It results in restricted flow of the gaseous stream of reaction material. It also reduces heat transfer through the tube wall to the gaseous stream. The temperature to which the tube is heated must then be raised to maintain a constant temperature in the stream flowing through the tube. This not only reduces process efficiency, but ultimately requires a temperature too high for equipment viability. Also, meeting safety requirements comes into question. This may be due to an embrittling, carburization reaction between carbon and the tube metal, or to a catastrophic, metal softening. A shutdown is therefore periodically necessary to remove the carbon formation, a process known as decoking.

In a catalytic reforming application, a pre-heater is used to heat naphtha feed-stocks up to a reaction temperature of about 550–650° C. before they enter a catalytic reforming reactor. A typical pre-heater is a bundle of 9Cr1Mo, A335 P9 metal pipes at a size of 4 inches diameter and 120 feet long. When naphtha hydrocarbons are exposed to temperatures of 550–650° C., coke formation, catalyzed by the metal surface, becomes inevitable. When coke is formed on the metal pipe surface, it will be transferred or carried by reactants to a catalytic reformer reactor. If the reactor is a fixed-bed reactor, the coke will be trapped in the catalyst bed, deactivate the reforming catalyst, and also cause a significant increase in pressure drop over processing time. When the overall pressure drop in the reactor exceeds the operational limit, the reactor has to be shut down to clean up the coke and regenerate the catalysts.

Numerous solutions to the problem of coking have been proposed. One such solution involves producing metal alloys having special compositions. Another proposed solution involves coating the interior wall of the tubing with a silicon-containing coating, such as silica, silicon carbide, or silicon nitride. In still other proposals, the interior wall of the tubing is treated with a chromium and/or an aluminum compound. A practice of incorporating additives, such as organic sulfur and phosphorus compounds, in the feedstock stream, in attempts to passivate the tube metal surfaces, has also been used in commercial processes.

Despite this intensive effort, the industry still faces the problem created by carbon deposition on the high temperature, tube metals. It is then a basic purpose of the present invention to provide a method of avoiding formation of carbon deposits on such metal surfaces.

A further purpose is to provide an improved material to inhibit coke deposition on a metal surface.

Another purpose is to provide a coated component for a thermal cracking or reforming furnace that resists carbon deposition during processing.

A still further purpose is to provide a method of inhibiting the deposition of carbons on a furnace component during a thermal cracking or reforming process.

Still another purpose is to provide a coating on the exposed surface of a furnace component to inhibit coke deposition on the component during a thermal cracking or reforming process.

SUMMARY OF THE INVENTION

The invention resides, in part, in a composite article comprising a metal substrate and a continuous, adherent, glass-ceramic coating on the surface of the metal substrate to insulate the article against an adverse effect of carbon on that surface, the glass-ceramic comprising at least two crystal phases, one phase being leucite and a second phase having a lower CTE than leucite over the range of 25–800° C. It further resides in a precursor glass for the glass-ceramic coating.

In another aspect, the invention resides in a thermal processing unit for a stream containing hydrocarbons, the unit operating at a temperature of at least 500° C. and comprising at least one metal tube that the hydrocarbon stream passes through at such temperature, the metal tube having a glass-ceramic coating on its interior surface, the glass-ceramic comprising at least two crystal phases, one phase being leucite and a second phase having a lower CTE than leucite over the range of 25–800° C.

The invention also resides in a method of protecting a metal article from adverse effects of carbon on the surface of the metal article which comprises providing a glass that is capable of being crystallized to a glass-ceramic comprising at least two crystal phases, one phase being leucite and a second phase having a lower CTE than leucite over the range of 25–800° C., forming a powder from the glass, applying a layer of the powdered glass over the surface to be protected and firing the coated metal on a schedule capable of softening the glass powder to form a continuous glass coating that crystallizes to a glass-ceramic having the at least two crystal phases.

BRIEF DESCRIPTION OF THE DRAWINGS

FIG. 2 is a graphical illustration of the manner in which the CTE of a crystal combination in a glass-ceramic in accordance with the invention can be varied.

BRIEF DESCRIPTION OF THE INVENTION

Figure 1:
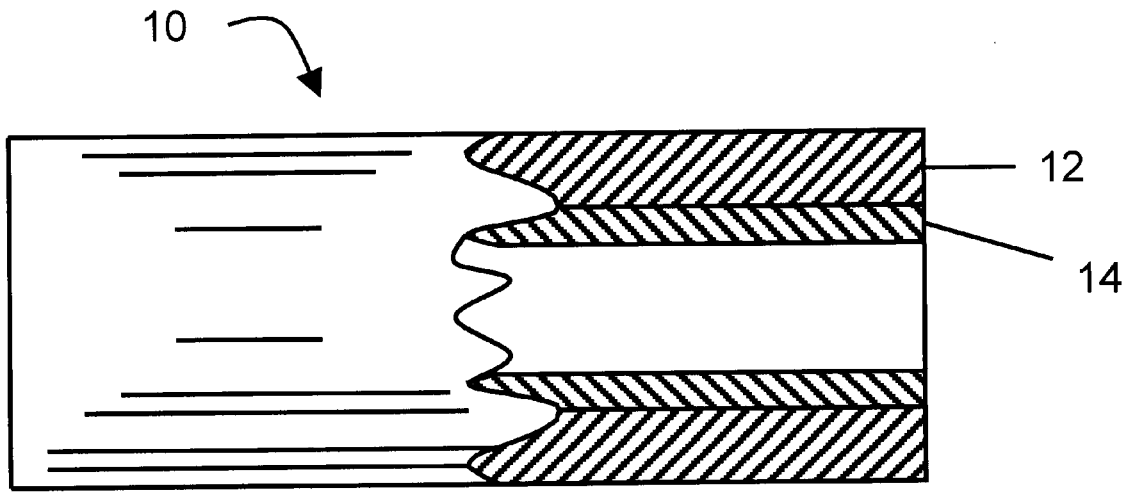
FIG. 1 is a front elevation, side view, partly broken away, showing a segment of a reactor tube for use in a thermal cracking furnace in accordance with the invention.

The present invention is concerned with protecting a metal surface from carbon layer buildup, a condition commonly referred to as coking, and from consequent embrittlement of the metal by carburization. It is particularly concerned with protecting the components in a hydrocarbon cracking furnace from such conditions. Accordingly, the invention is described with respect to that specific utility, but the broader application will be apparent to those concerned with metal protection.

FIG. 1 is a front elevation, side view, partly broken away. It shows a segment 10 of a reactor tube for use in a thermal cracking furnace in accordance with the invention. Such a reactor tube may be up to twelve meters (40 feet) in length. It may have a diameter as small as 2.5 cm. (1 inch), or as large as 20 cm. (8 inches). Segment 10 comprises a cast alloy tube 12 having a coating 14 formed on its inner surface.

It will be appreciated that a thermal cracking furnace will comprise a serpentine array of tubes and fittings, such as elbows, or it may be parallel, manifolded, straight tubes. It is contemplated that a complete cracking furnace, including reactor tubes and fittings, will be coated in accordance with the invention. However, short lengths of tubing may be coated and joined, as by welding.

Coating 14, in accordance with the invention, is a glass-ceramic composition. It forms a seamless interface between the surface of a metal article, such as reactor tube 12, and the coating to provide coking resistance and thermal stability. This glass-ceramic coating is based on a glass that can be cerammed to a glass-ceramic that is characterized by a leucite ($K_2O$—$Al_2O_3$— $4SiO_2$) crystal phase and at least one additional crystal phase. The additional crystal phase, or phases, will have a linear CTE below that of leucite. This permits choosing a precursor glass composition that produces the crystal phases present in amounts such that a desired CTE between that of the added crystal and leucite can be provided.

The additional crystal phases are preferably selected from a group consisting of nepheline, anorthite, akermanite and forsterite. Coatings containing nepheline provide a smooth, uniform coating. However, at high temperatures in reducing environments, they may undergo a change that alters the high CTE. Coatings containing anorthite have been found to be more stable at high temperatures, and hence are preferred for such use. By tailoring the glass composition, the nature and amount of the crystal phases can be developed to provide average CTEs (25–800° C.) that range from $100–240\times10^{-7}/°$ C.

This permits matching the expansion coefficients of a variety of different metal alloys used in processes that involve contact of the metal alloy surface with carbon. Matching the average CTE of a coating with that of an alloy substrate minimizes development of thermal stresses, thereby improving both the performance and the lifetime of the coating. This is particularly important in the chemical processing industry where alloys of varying CTEs are employed in different processes that may also involve high temperature thermal treatments.

TABLE I, below, broadly circumscribes, in both mole and weight percent, the compositional limits for glasses that are suited to use in the present invention:

TABLE I

| | mole % | weight % |
|---|---|---|
| $SiO_2$ | 45–75 | 35–61 |
| $Al_2O_3$ | 4–25 | 6–35 |
| $R_2O$ | 0–25 | 0–30 |
| RO | 0–40 | 0–40 |

$R_2O$ generally designates alkali metal oxides, particularly $Na_2O$, $K_2O$ and $Li_2O$. Preferably, the glass composition contains 5–20 mole % $K_2O$ and 0– 15 mole % $Na_2O$, the total $K_2O$+$Na_2O$ being 5–25 mole %. RO generally designates alkaline earth metal oxides, particularly CaO and MgO. Preferably, the glass composition will contain 0–25 mole % CaO, 0–30 mole % MgO, the total CaO+MgO content being not over 35%. In addition, oxides of the transition metals, including Ti, Mn, Fe, Co, W and Mo, may, optionally, be included in amounts up to 15 mole percent, equivalent to 40 weight percent of the glass composition. These oxides tend to enhance bonding of the material to a metal substrate.

These glasses may self-nucleate. Thus, when reduced to small particles for coating purposes, the small glass particles may serve as nucleation sites for crystals to be developed by appropriate thermal treatment. Alternatively, up to about 15 mole, or weight, percent of $TiO_2$ and/or $ZrO_2$ may be included in the glass composition to serve as a nucleating agent. Up to 5% $B_2O_3$ may be included in the composition if necessary to flux a high viscosity glass.

TABLE II, below, sets forth in mole percent, on an oxide basis, several compositions for glasses thermally convertible to glass-ceramics exhibiting two crystal phases in accordance with the present invention. The average CTE values (25–800° C.) for glass-ceramics produced from these glasses are shown. Also shown are the crystal phases exhibited by glass-ceramics produced by thermal treatment of these glasses.

TABLE II

| Phase | $SiO_2$ | $Al_2O_3$ | $K_2O$ | $Na_2O$ | CaO | MgO | $TiO_2$ | CTE |
|---|---|---|---|---|---|---|---|---|
| Leucite | 66.7 | 16.7 | 16.7 | | | | | 260 |
| Nepheline | 50.0 | 25.0 | | 25.0 | | | | 130 |
| Anorthite | 50.0 | 25.0 | | | 25.0 | | | 65 |
| Akermanite | 40.0 | | | | 40.0 | 20.0 | | 110 |
| Forsterite | 33.3 | | | | | 66.6 | | 80 |
| Leucite-Nepheline + glass | 61.8 | 19.1 | 6.7 | 12.4 | | | 5.0 | 120 |
| Leucite-Nepheline | 61.9 | 19.1 | 9.0 | 10.0 | | | 5.0 | 190 |
| Leucite-Anorthite | 58.2 | 20.9 | 8.2 | | 12.8 | | | 149 |

TABLE II-continued

| Phase | $SiO_2$ | $Al_2O_3$ | $K_2O$ | $Na_2O$ | CaO | MgO | $TiO_2$ | CTE |
|---|---|---|---|---|---|---|---|---|
| Leucite-Anorthite | 65.0 | 17.5 | 15.0 | | 2.5 | | 5.0 | 237 |
| Leucite-Akermanite | 52.8 | 8.0 | 8.0 | | 20.9 | 10.4 | | 184 |
| Leucite-Akermanite | 57.0 | 10.6 | 10.6 | | 14.6 | 7.3 | | 212 |
| Leucite-Forsterite | 58.3 | 12.5 | 12.5 | | | 16.7 | | 227 |

A glass batch, corresponding to each of the compositions of TABLE II, was mixed employing standard glass-making materials, such as oxides, carbonates and nitrates. The batches, thus prepared, were melted in crucibles of either two or ten lb. size in an electric furnace at temperatures not over 1650° C. for times not over 20 hours. Clear, single-phase, well-fined glass melts were obtained with each batch. Each melt was poured, the glass reduced to particles, and the particles pressed into bars. The pressed bars were sintered and thermally cerammed preparatory to making average CTE and X-RD measurements thereon.

FIG. 2, in the accompanying drawings, is a graphical representation of the average CTE for members of a typical glass-ceramic family of the invention. It shows the linear manner in which this value varies with the ratio of crystal phases in members of the family.

In the FIGURE, average CTE$\times 10^{-7}$/° C. (25–800° C.) is plotted on the vertical axis. The ratio of percent anorthite crystal phase to the total crystal phase present, that is, anorthite plus leucite, is plotted on the horizontal axis.

It is apparent that the average CTE decreases linearly with respect to the increasing amount of anorthite in the glass-ceramic. This illustrates the manner in which the average CTE of a glass-ceramic family within the present invention may be tailored by composition control. In this way, an expansion match with a given metal substrate may be achieved.

Each family shown in TABLE II was studied in the manner illustrated in FIG. 2. A similar, linear, CTE relationship, although of different magnitude, was found to exist for each family.

Test pieces of HP-45, an Fe—Ni—Cr alloy commonly used in thermal cracking furnaces, were cut from a metal pipe and prepared for each family. A powdered glass, selected from each family, was blended with a vehicle. Each blend was applied in a thin layer over the surface of the alloy substrate, for example, by spraying. The coated test pieces were dried and fired on appropriate ceramming cycles to produce glass-ceramic, coated test pieces. The coatings were observed to be adherent to the alloy surfaces, to be continuous, and to be free of defects, such as pinholes, cracks, or thin spots.

The test pieces were thermally cycled in accordance with anticipated service conditions. Specifically, a simulated life test consisted of packing the coated, metal test pieces in a bed of carbon and heating at 1100° C. for 144 hours in an atmosphere of forming gas and 30% steam. The packing in a bed of carbon represented coke deposition in a furnace. The forming gas provided highly reducing conditions comparable to those commonly encountered in thermal cracking furnaces.

Subsequently, the test was modified to more closely represent actual production conditions. To this end, the bed of carbon was eliminated and a stream of ethane was passed over the test pieces rather than forming gas. This also allowed direct observation of the degree of coking prevention provided by each coating.

It was recognized that, in production, a furnace may have to be cooled to room temperature and reheated several times during the life of the furnace. It is this thermal cycling that is believed to cause spalling of a coating. Accordingly, coated test pieces were subjected to a thermal cycling test. This test consisted of four (4) cycles in which the glass-ceramic, coated test pieces were heated to 1100° C., held at that temperature for an hour, and then cooled to room temperature.

Following these tests, the several test pieces were examined using SEM and XRO techniques. These determined what changes, if any, had occurred in morphology and crystal phase assemblage, respectively. Successful coatings were found in each of the two-phase families represented in TABLE II above. These coatings showed no signs of delamination or spalling from the alloy substrate and substantially reduced coke formation compared to the uncoated substrate. Also, the crystal phase assemblage remained unchanged, that is, there were no signs of substantial change in physical or chemical structure.

We claim:

1. A composite article comprising a metal substrate and a continuous, adherent, glass-ceramic coating on the surface of the metal substrate to insulate the article against an adverse effect of carbon on that surface, the glass-ceramic comprising at least two crystal phases, one phase being leucite and a second phase having a lower CTE than leucite over the range of 25–800° C.

2. A composite article in accordance with claim 1 wherein the second crystal phase is selected from the group consisting of nepheline, anorthite, akermanite and forsterite and the glass-ceramic has a CTE in the range of 100–240$\times 10^{-7}$/° C.(25–800° C.).

3. A composite article in accordance with claim 2 wherein the second crystal phase is nepheline or anorthite.

4. A composite article in accordance with claim 1 wherein the glass-ceramic coating has a composition consisting essentially of

| | mole % | weight % |
|---|---|---|
| $SiO_2$ | 45–75 | 35–61 |
| $Al_2O_3$ | 4–25 | 6–35 |
| $R_2O$ | 0–25 | 0–30 |
| RO | 0–40 | 0–40. |

5. A composite article in accordance with claim 1 that is a component of a thermal processing apparatus for a fluid stream of hydrocarbons, the component having a surface normally exposed to the deposit of carbon on that surface, the surface having a thin layer of a glass-ceramic adherent to that surface to inhibit the carbon from depositing thereon, the glass-ceramic coating comprising at least two crystal phases, one phase being leucite, and a second phase having a lower CTE than leucite over the range of 25–800° C.

6. A composite article in accordance with claim 5 wherein the second crystal phase is selected from nepheline, anorthite, akermanite and forsterite and the glass-ceramic has a CTE in the range of 100–240$\times 10^{-7}$/° C. (25–800° C.).

7. A composite article in accordance with claim 5 wherein the component is a pre-heater in a catalytic reforming apparatus.

8. A composite article in accordance with claim 5 wherein the component is a reactor tube in a thermal cracking furnace.

9. A composite article in accordance with claim 8 wherein the reactor tube is composed of an Fe—Ni—Cr alloy.

10. A precursor glass for a glass-ceramic, the glass being capable of being melted and poured at a temperature not over 1650° C., the glass being thermally crystallizable to a glass-ceramic containing at least two crystal phases, one phase being leucite and a second phase having a lower CTE than leucite over the range of 25–800° C.

11. A precursor glass for a glass-ceramic in accordance with claim 10 wherein the second phase is selected from the group consisting of nepheline, anorthite, akermanite and forsterite, the glass-ceramic having a CTE in the range of $100–240\times10^{-7}/°$ C. (25–800° C.).

12. A precursor glass in accordance with claim 10, the composition of which contains, in mole percent on an oxide basis, 45–75% $SiO_2$, 4–25% $Al_2O_3$, 0–25% $R_2O$ and 0–40% RO.

13. A precursor glass in accordance with claim 12 that contains, in mole %, 5–20% $K_2O$ and 0–15% $Na_2O$, the total $K_2O+Na_2O$ being 5–25%.

14. A precursor glass in accordance with claim 12 wherein RO, in mole %, consists of 0–30% CaO and/or 0–30% MgO, the total CaO+MgO being not over 35%.

15. A precursor glass in accordance with claim 12 which additionally contains up to 5% $B_2O_3$ as a fluxing agent.

16. A precursor glass in accordance with claim 12 which additionally contains up to 15% $TiO_2$ and/or $ZrO_2$ as a nucleating agent.

17. A precursor glass in accordance with claim 12 which contains up to 40% by weight of a transition metal oxide.

18. A thermal processing unit for a stream containing hydrocarbons, the unit operating at a temperature of at least 500° C., and the unit comprising at least one metal tube that the hydrocarbon stream passes through at such temperature, the metal tube having a glass-ceramic coating on its interior surface, the glass-ceramic comprising at least two crystal phases, one phase being leucite and a second phase having a lower CTE than leucite over the range of 25–800° C.

19. A thermal processing unit in accordance with claim 18 wherein the second crystal phase is selected from the group consisting of nepheline, anorthite, akermanite and forsterite and the glass-ceramic has a CTE in the range of $100–240\times10^{-7}/°$ C. (25–800° C.).

20. A thermal processing unit in accordance with claim 18 wherein the unit is a catalytic reforming apparatus operating at a temperature in the range of 550–650° C.

21. A thermal processing unit in accordance with claim 18 which is a thermal hydrocracking unit operating in a temperature range of 750–850° C.

22. A method of protecting a metal article from adverse effects of carbon on the surface of the metal article which comprises providing a glass that is capable of being crystallized to a glass-ceramic comprising at least two crystal phases, one phase being leucite and a second phase having a lower GTE than leucite over the range of 25–800° C., forming a powder from the glass, applying a layer of the powdered glass over the surface to be protected and firing the coated metal on a schedule capable of softening the glass powder to form a continuous glass coating that crystallizes to a glass-ceramic having the at least two crystal phases.

23. A method in accordance with claim 22 wherein the second crystal phase is selected from the group consisting of nepheline, anorthite, akermanite and forsterite and the glass-ceramic has a CTE in the range of $100–240\times10^{-7}/°$ C. (25–800° C.).

* * * * *